US007025170B2

(12) United States Patent
Lin

(10) Patent No.: US 7,025,170 B2
(45) Date of Patent: Apr. 11, 2006

(54) SPEAKER

(76) Inventor: Steff Lin, 8Fl., No. 18 Lane 30, Kuo Hsing St., His Chih City, Taipei Hsien (TW)

( * ) Notice: Subject to any disclaimer, the term of this patent is extended or adjusted under 35 U.S.C. 154(b) by 346 days.

(21) Appl. No.: 10/698,474

(22) Filed: Nov. 3, 2003

(65) Prior Publication Data

US 2005/0092543 A1 May 5, 2005

(51) Int. Cl.

| | |
|---|---|
| ***G10K 13/00*** | (2006.01) |
| ***H04R 7/22*** | (2006.01) |
| ***H04R 7/18*** | (2006.01) |
| ***H04R 9/04*** | (2006.01) |
| ***H04R 11/02*** | (2006.01) |

(52) U.S. Cl. ..... 181/171; 381/398; 381/433

(58) Field of Classification Search ..... 181/171, 181/172, 166; 381/398, 404, 433, 396, 403, 381/405

See application file for complete search history.

(56) References Cited

U.S. PATENT DOCUMENTS

| | | | | | |
|---|---|---|---|---|---|
| 2,261,111 | A * | 11/1941 | Engholm | 381/404 |
| 2,329,560 | A * | 9/1943 | Seabert | 181/164 |
| 3,201,529 | A * | 8/1965 | Surh | 381/186 |
| 3,767,004 | A * | 10/1973 | Liebscher | 181/172 |
| 4,440,260 | A * | 4/1984 | Jacobsen | 181/172 |
| 5,115,474 | A * | 5/1992 | Tsuchiya et al. | 381/398 |
| 5,687,247 | A * | 11/1997 | Proni | 381/398 |
| 5,734,131 | A * | 3/1998 | Sakamoto | 181/141 |
| 5,940,522 | A * | 8/1999 | Cahill et al. | 381/397 |
| 6,118,884 | A * | 9/2000 | Proni | 381/403 |
| 6,173,065 | B1 * | 1/2001 | Lin | 381/398 |
| 6,757,402 | B1 * | 6/2004 | Chan | 381/396 |
| 6,938,726 | B1 * | 9/2005 | Roark et al. | 181/171 |
| 2004/0228500 | A1 * | 11/2004 | Stiles | 381/398 |
| 2005/0180590 | A1 * | 8/2005 | Proni | 381/396 |
| 2005/0185816 | A1 * | 8/2005 | Roark et al. | 381/400 |

FOREIGN PATENT DOCUMENTS

| | | | |
|---|---|---|---|
| JP | 55003212 | A * | 1/1980 |
| JP | 58039199 | A * | 3/1983 |

* cited by examiner

*Primary Examiner*—Edgardo San Martin
(74) *Attorney, Agent, or Firm*—Bacon & Thomas, PLLC

(57) ABSTRACT

A speaker in which the basket holding the voice coil, cone and damper has a ribbed top flange and a ribbed bottom flange, a gasket is capped on the suspension of the cone at the ribbed top flange and fastened thereto with screws without the use of glue, and a holder frame is pressed on the periphery of the damper at the ribbed bottom flange and fastened thereto with screws.

2 Claims, 6 Drawing Sheets

SPEAKER

BACKGROUND OF THE INVENTION

1. Field of the Invention

The present invention relates generally to speakers and, more particularly, to such a speaker that can rapidly be assembled and easily be detached from the speaker for a repair work or replacement without the use of glue.

2. Description of the Related Art

A regular speaker is generally comprised of a base, a magnet, a basket, a cone, a damper, and a voice coil. During assembly, the cone and the damper are respectively fixedly fastened to the basket by glue. This assembly procedure is complicated and not efficient. Further, when the cone, the voice coil, or the damper damaged, the speaker becomes useless and must be thrown away. It is not economic to throw the whole assembly of the speaker away when one part of the speaker damaged. Further, the waste speaker must be properly disposed of, preventing damage to the environment.

SUMMARY OF THE INVENTION

The present invention has been accomplished under the circumstances in view. It is the main object of the present invention to provide a speaker, which structure is detachable. It is another object of the present invention to provide a speaker, which enables the user to conveniently replace damaged cone, damper, or voice coil of piston system without the use of glue. To achieve these and other objects of the present invention, the speaker is comprised of a T-yoke, a washer, a basket, a magnet, a cone, a voice coil, and a damper, wherein the basket comprises a top flange, a bottom flange, a plurality of screw holes at the top flange, and a plurality of through holes at the bottom flange; the cone has a suspension extended around of the periphery thereof and rested on the top flange of the basket, a gasket is covered on the periphery of the suspension at the top flange of the basket, the gasket having a bottom groove capped on a protruded part of the suspension at the basket, and a plurality of mounting through holes respectively fastened to the screw holes at the top flange of the basket by screws; the damper is peripherally mounted on the bottom flange of the basket; a holder frame is fastened to the basket to hold the damper in place, the holder frame having a bottom groove capped on the periphery of the damper at the bottom flange of the basket, and a plurality of screw holes respectively fastened to the mounting through holes at the bottom flange of the by screws.

DETAILED DESCRIPTION OF THE INVENTION

Figure 1:
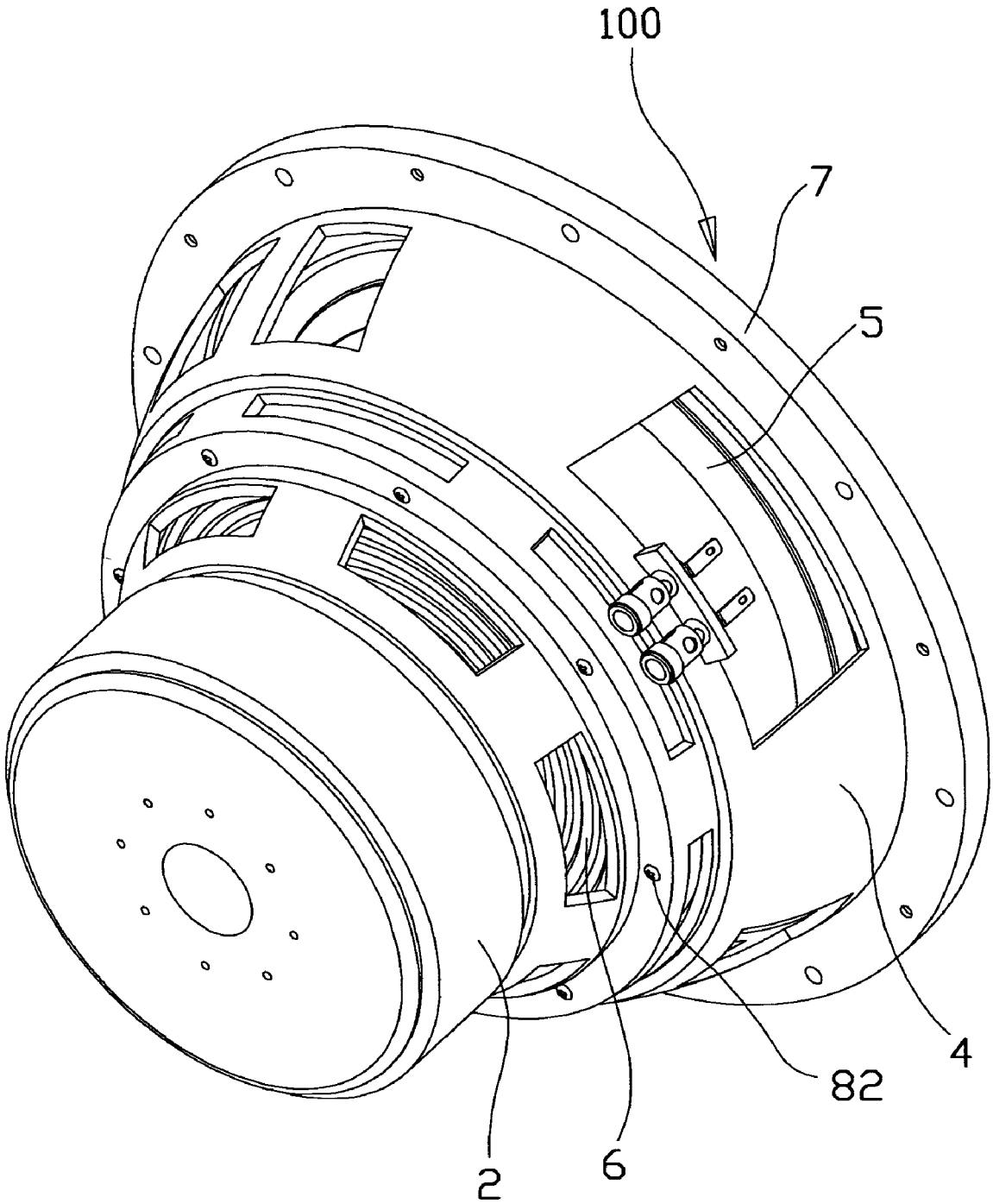
FIG. 1 is an oblique rear elevational view of a speaker according to the present invention.
Figure 2:
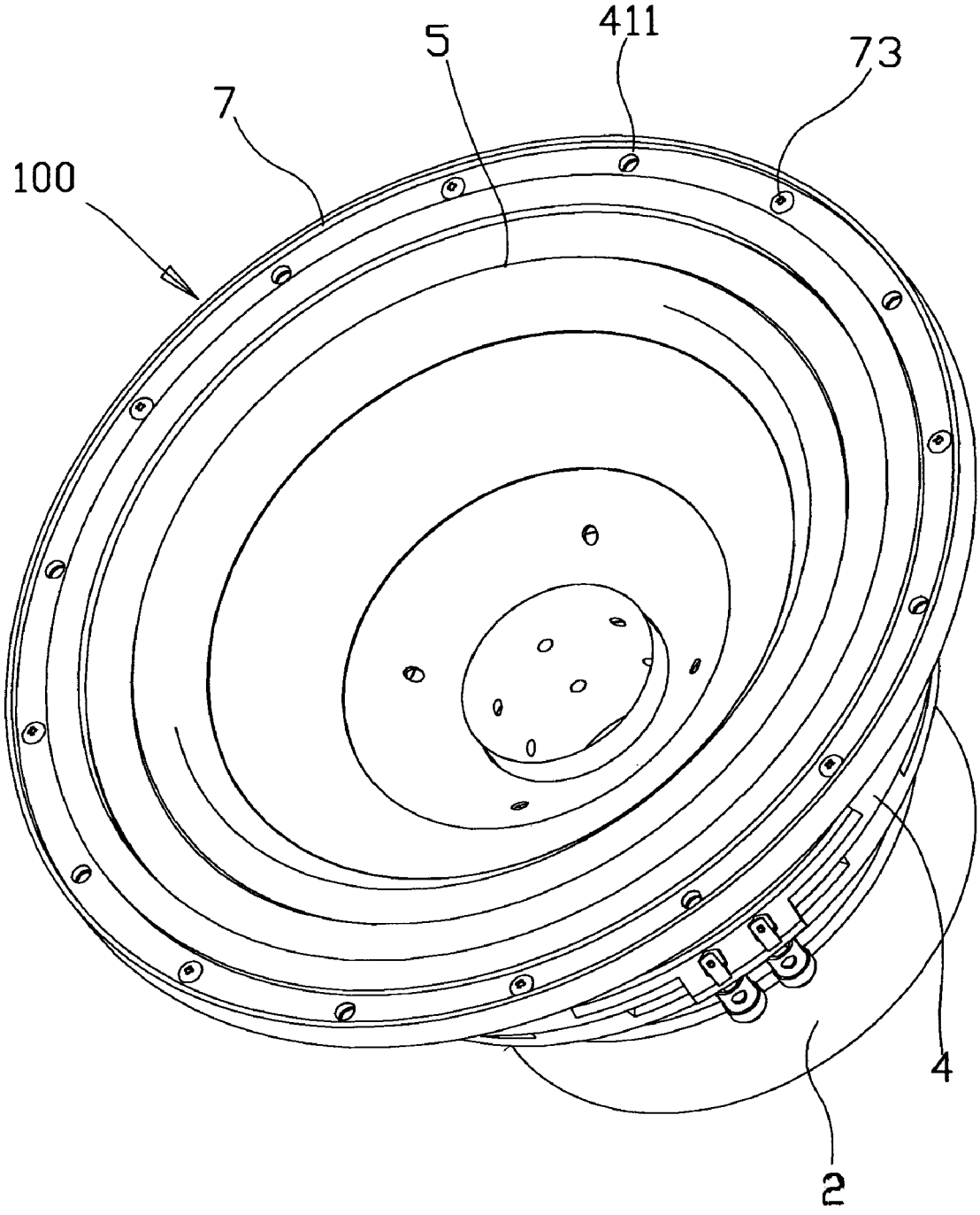
FIG. 2 is an oblique front elevational view of the speaker according to the present invention.
Figure 3:
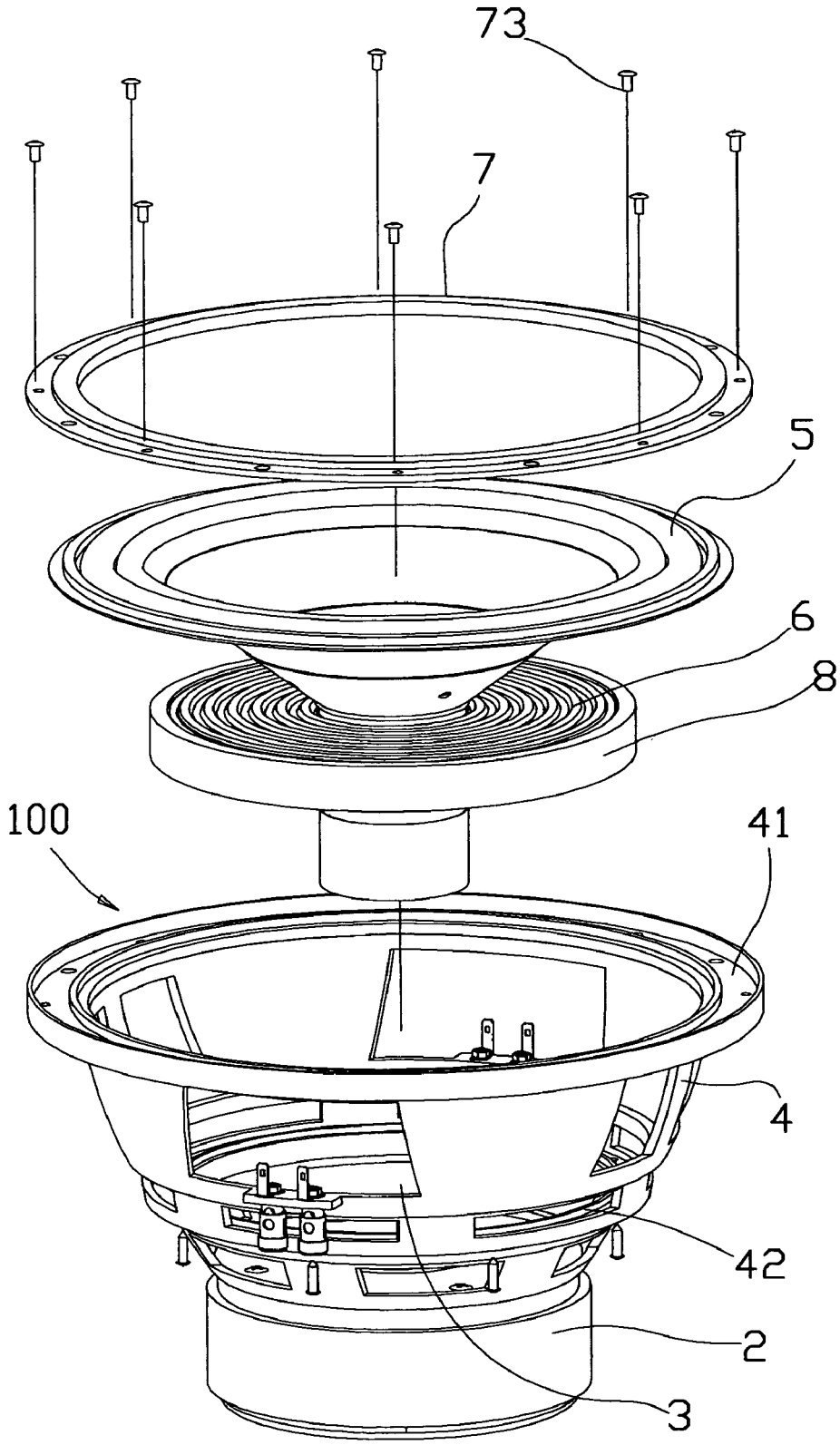
FIG. 3 is an exploded view of the speaker according to the present invention.
Figure 4:
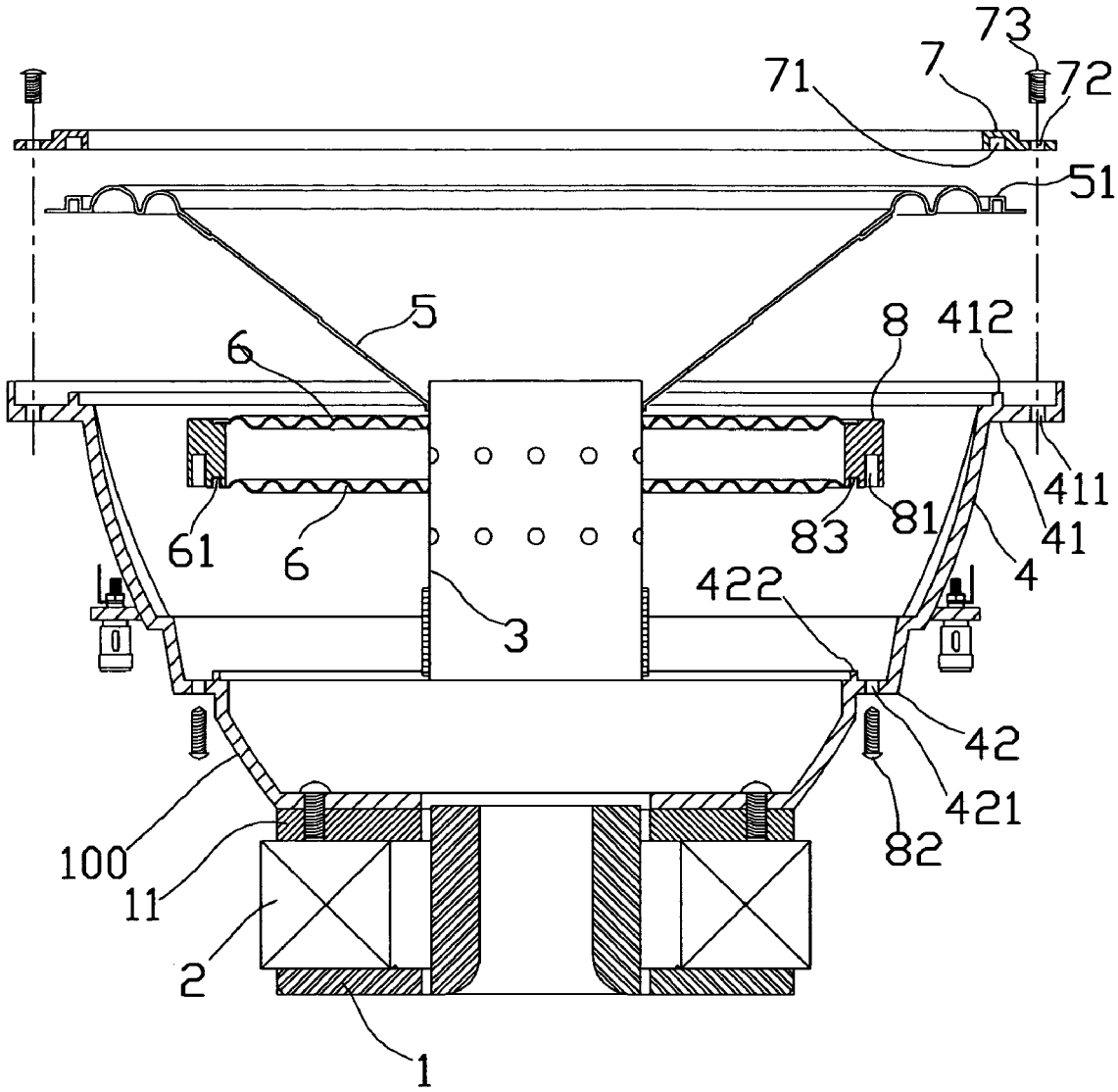
FIG. 4 is a sectional exploded view of the speaker according to the present invention.

Referring to FIGS. 1~4, a speaker 100 in accordance with the present invention is shown comprising a T-yoke 1, a washer 11, a magnet 2 mounted in between the T-yoke 1 and the washer 11, a basket 4 provided at the top side of the washer 11, a voice coil 3, a cone 5, a damper 6, a gasket 7, and a holder frame 8. The basket 4 holds the voice coil 3, the cone 5 and the damper 6 in place, having a top flange 41, a bottom flange 42, a first rib 412 and a plurality of screw holes 411 at the top flange 41, and a second rib 422 and a plurality of through holes 421 at the bottom flange 42.

The cone 5 has a suspension 51 of substantially ⊓-shaped cross section extended around of the periphery and clamped on the top rid 412 of the basket 4. The gasket 7 has a bottom groove 71 of substantially ⊓-shaped cross section capped on the suspension 51 at the first rib 412 of the basket 4, and a plurality of mounting through holes 72 respectively fastened to the screw holes 411 of the basket 4 by screws 73. The damper 6 is peripherally mounted on the second rib 422 at the bottom flange 42 of the basket 4. The holder frame 8 has a bottom groove 81 of substantially ⊓-shaped cross section capped on the periphery of the damper 6 at the second rib 422 of the basket 4, and a plurality of screw holes 83 respectively fastened to the mounting through holes 421 of the basket 4 by screws 82.

By means of the aforesaid arrangement, the cone 5, the damper 6, and the holder frame 8 can easily rapidly be installed in the basket 4. In case the cone 5, the damper 6, or the voice coil 3 is damaged, the damaged member can easily be detached from the speaker 100 for a repair work or replacement.

Figure 5:
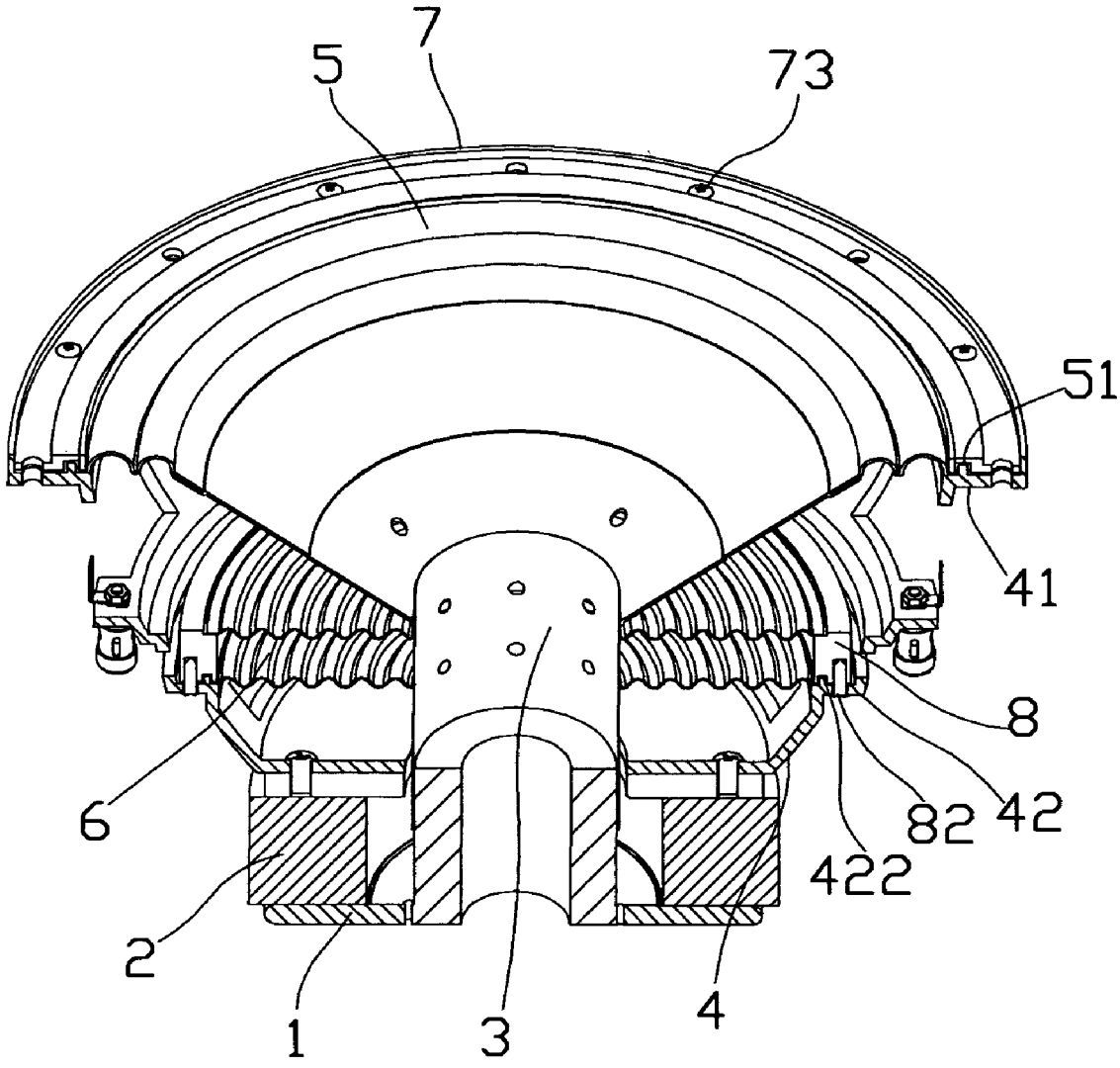
FIG. 5 is a cutaway view of a part of the speaker according to the present invention.
Figure 6:
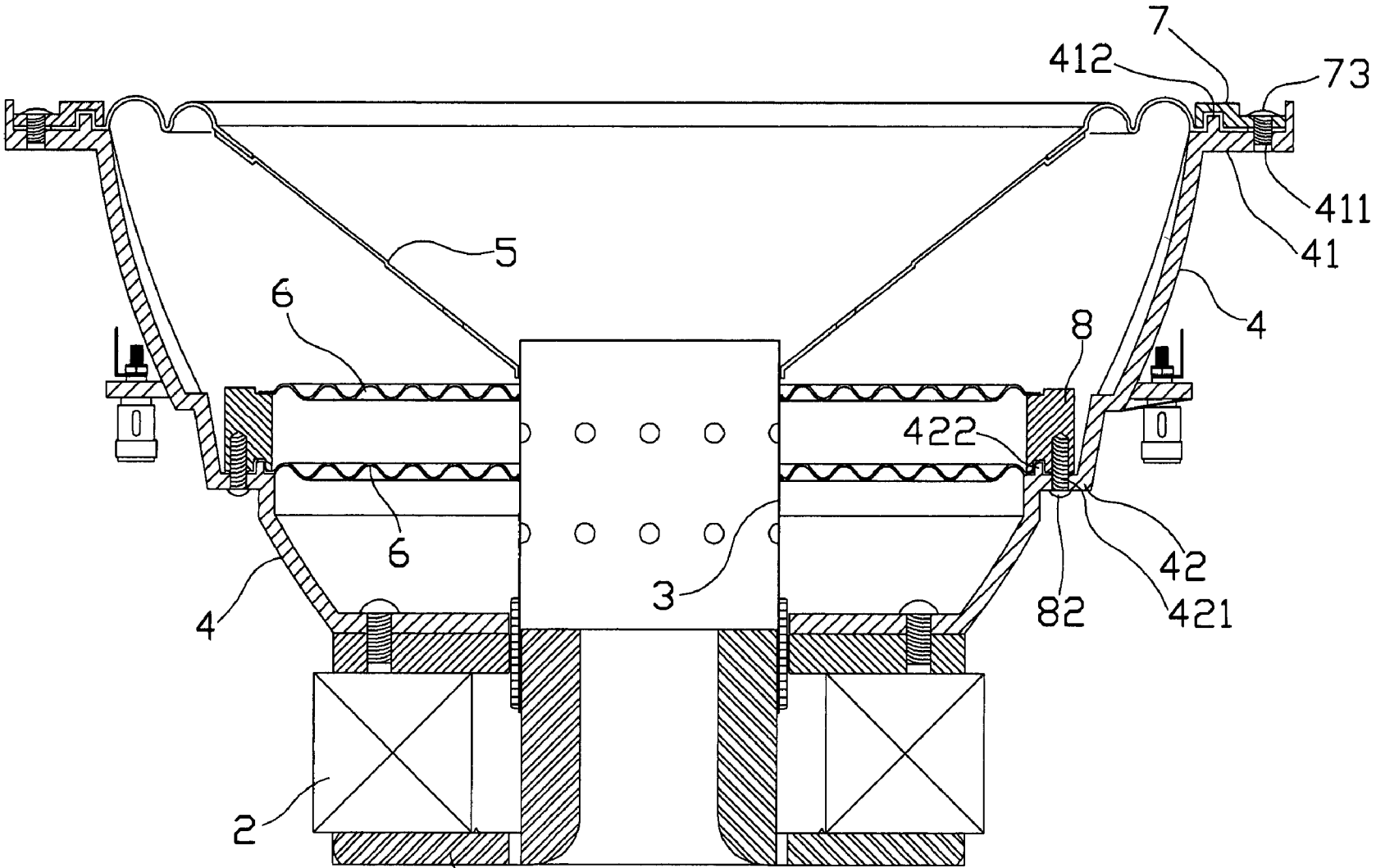
FIG. 6 is a sectional assembly view of the speaker according to the present invention.

Referring also to FIGS. 5 and 6, the cone 5, the damper 6, and the holder frame 8 are respectively fastened to the basket 4 by screws 73 and 82 without the use of glue, the parts of the speaker 100 can easily rapidly be detached from the speaker 100 for a repair work or replacement.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A speaker comprising:

a T-yoke;

a washer;

a magnet mounted in between said T-yoke and said washer;

a basket provided at a top side of said washer;

a voice coil mounted in said basket;

a cone mounted in said basket; and a damper mounted in said basket around said voice coil;

wherein said basket comprises a top flange, a bottom flange, a plurality of screw holes at said top flange, and a plurality of through holes at said bottom flange; said cone has a suspension extended around of the periphery thereof and rested on said top flange of said basket; a gasket is covered on the periphery of said suspension at said top flange of said basket, said gasket having a bottom groove capped on a protruded part of said suspension at said basket, and a plurality of mounting through holes respectively fastened to the screw holes at said top flange of said basket by screws; said damper is peripherally mounted on said bottom flange of said basket; a holder frame is fastened to said basket to hold said damper in place, said holder frame having a bottom groove capped on the periphery of said damper at said bottom flange of said basket, and a plurality of screw holes respectively fastened to the mounting through holes at said bottom flange of said basket by screws.

2. The speaker as claimed in claim 1, wherein said basket further comprises a first rib disposed at said top flange corresponding to the bottom groove of said gasket and adapted to support the suspension of said cone, and a second rib disposed at said bottom flange corresponding to the bottom groove of said holder frame and adapted to support the periphery of said damper.

* * * * *